United States Patent [19]

Paton et al.

[11] 4,108,235

[45] Aug. 22, 1978

[54] ELECTROSLAG REMELTING APPARATUS HAVING RELATIVE MOLD MOVEMENT AND PROVISION FOR INTRODUCTION OF SLAG

[76] Inventors: Boris Evgenievich Paton, ul. Kotsjubinskogo 9, kv. 21; Boris Izrailevich Medovar, Bulvar Lesi Ukrainki 2, kv. 8; Jury Vadimovich Latash, Vozdukhoflotsky prospekt 87, kv. 14; Leonty Vasilievich Chekotilo, ulitsa Scherbakova, 49-a, kv. 10; Vitaly Mikhailovich Baglai, ulitsa Semashko 10, kv. 54/3; Viktor Leonidovich Artamonov, ulitsa Sovetskaya 9, kv. 4; Rodimir Ivanovich Garkaljuk, ulitsa Bolshaya, kitaevskaya, 142 korpus 14, kv.33; Viktor Anatolievich Timchenko, ulitsa Vladimirskaya 98/3, kv. 36; Evgeny Fedorovich Malichenko, prospekt Entuziastov 7/12, kv. 161; Leonid Mikhailovich Stupak, Brest-Litovsky prospekt 39, kv. 9; Rudolf Solomonovich Dubinsky, Brestlitovsky prospekt 11, kv. 15, all of Kiev, U.S.S.R.

[21] Appl. No.: 506,719

[22] Filed: Sep. 17, 1974

Related U.S. Application Data

[60] Continuation of Ser. No. 124,836, Mar. 16, 1971, abandoned, which is a division of Ser. No. 771,165, Oct. 28, 1968, abandoned.

[51] Int. Cl.[2] ..... B22D 27/02

[52] U.S. Cl. ..... 164/252; 162/52

[58] Field of Search ..... 164/52, 252, 85, 136

[56] References Cited

U.S. PATENT DOCUMENTS

| | | | |
|---|---|---|---|
| 2,369,233 | 2/1945 | Hopkins | 164/52 |
| 2,405,254 | 8/1946 | Hopkins | 249/180 |
| 3,409,068 | 11/1968 | Yearley et al. | 164/85 |
| 3,670,089 | 6/1972 | Paton et al. | 13/9 |

FOREIGN PATENT DOCUMENTS

| | | | |
|---|---|---|---|
| 689,297 | 1/1967 | Belgium | 164/252 |
| 1,103,350 | 2/1968 | United Kingdom | 164/52 |

*Primary Examiner*—Robert L. Spicer, Jr.

*Attorney, Agent, or Firm*—Strauch, Nolan, Neale, Nies & Kurz

[57] ABSTRACT

Apparatus for electroslag remelting of at least one consumable electrode in a cooled mold assembly with a cooled bottom plate having mechanism accomplishing relative movement between at least a part of the mold assembly and the ingot being formed during forming of the ingot. Movement of selective parts of the mold assembly relative to the ingots and/or the electrode is provided with or without movement of the electrode itself. Structure for bottom pouring of molten slag is provided. A specified mold assembly has, as an element, a cooled core device enabling making hollow ingots, in which case the hollow core device can be moved axially, reciprocated axially and reciprocally rotated during forming of the ingot. Electrical power for the electroslag remelting can be connected between the consumable electrode and any or all elements of the mold assembly.

37 Claims, 3 Drawing Figures

ELECTROSLAG REMELTING APPARATUS HAVING RELATIVE MOLD MOVEMENT AND PROVISION FOR INTRODUCTION OF SLAG

CROSS-REFERENCE TO RELATED APPLICATIONS

This application is a continuation of our co-pending application Ser. No. 124,836, filed Mar. 16, 1971 now abandoned as a division of our then co-pending application Ser. No. 771,165, for METHOD OF OBTAINING METAL HOLLOW INGOTS BY ELECTROSLAG REMELTING AND DEVICE FOR EFFECTING SAME, filed Oct. 28, 1968, now abandoned, and replaced by continuation application Ser. No. 129,168, which issued as U.S. Pat. No. 3,721,286, entitled METHOD OF OBTAINING METAL HOLLOW INGOTS BY THE ELECTROSLAG REMELTING.

BACKGROUND OF THE INVENTION

The present invention relates to methods for obtaining metal hollow ingots by electroslag remelting, and to devices for effecting same. The invention may be made use of for obtaining hollow ingots of pipe stock from steels, alloys and metals (ball-bearing, highly alloyed, heat-resistant, anticorrosive, high-strength structural, and the like including those difficult to work), intended for being subsequently processed into pipes and other articles by pressing, rolling out, rolling, etc.

Known in the prior art is a method for obtaining hollow metal ingots by the electroslag remelting of a hollow (in the tubular form) consumable electrode in a cooled annular ingot mold composed of a cooled mold and a cooled bottom plate together with a cooled core being made stationary in relation therewith.

In this case, a consumable electrode is remelted in an annular gap between the mold and core. During the entire remelting process of a hollow ingot, the slag bath is given an annular form. Its cross section is almost equal to that of a hollow ingot to be made.

A disadvantage of the prior-art method consists first of all in that for making ingots there are employed expensive hollow (in the tubular form) consumable electrodes. Moreover, the hollow ingot to be built-up squeezes the core during shrinkage, which may cause cracking in the ingot, and as a result the core will have to be removed from each ingot by mechanical means.

A primary object of the present invention is to provide such apparatus using electroslag remelting to make ingots, particularly hollow ingots, which would permit using cheap consumable electrodes of a solid section (both deformed or cast), precluding the formation of cracks in the ingot, making ingots, particularly hollow ingots possessing a good internal surface, to be directly used for further processing.

In conformity with these and other objects of the invention, the proposed device or apparatus for making metal hollow ingots by the electroslag remelting of a consumable electrode in a cooled mold having a core disposed therein, the core forming the internal cavity of the ingot being built up on a cooled bottom plate, features, according to the invention, a mold, a core and a bottom plate together with an ingot secured thereon in the process of remelting the consumable electrode, which are given longitudinal motion in relation to each other so that the upper end face of the core is constantly immersed in the molten slag bath.

The mutual motion of the mold, core and bottom plate may be carried into effect either by moving the cooled core upwardly in relation to the stationary mold and bottom plate, or by moving the bottom plate together with the ingot secured thereon downwardly in relation to the core and stationary mold, or, finally, by moving the mold together with the bottom plate and the ingot secured thereon and being built-up downwardly in relation to the core.

To improve the internal surface of the hollow ingot being made, the core during the remelting process should be given rocking motion.

The device for carrying into effect the proposed method, comprising a cooled mold, a bottom plate and a core for shaping a cavity in the ingot being built-up, according to the invention, is provided with mechanisms for effecting mutual motion of the mold, bottom plate and core in the process of remelting a consumable electrode.

The device is preferably provided with a mechanism for imparting to the cooled core a rocking motion in a longitudinal direction, and a mechanism for imparting to the core reciprocal rotary motion.

The nature of the present invention will further be made more fully apparent from a consideration of the following description of its exemplary embodiments, taken in conjunction with the accompanying drawings.

BRIEF DESCRIPTION OF DRAWINGS

Preferred structural embodiments of this invention are disclosed in the accompanying drawings in which.

Figures 1, 2:
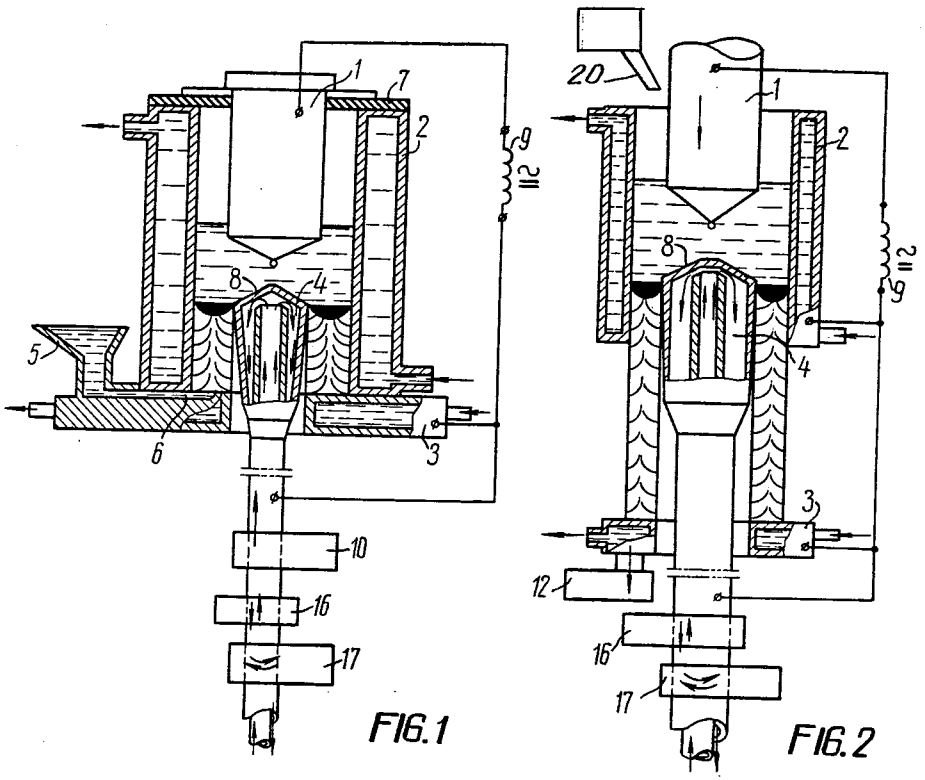
FIG. 1 represents a device for obtaining hollow ingots by the electroslag remelting of a consumable electrode, which, according to the invention, is provided with a mechanism for moving a core in relation to a stationary mold and bottom plate.
FIG. 2 shows the same device complete with a mechanism for moving a bottom plate together with an ingot in relation to the core and stationary mold.

The remelting of the consumable electrode 1 (FIGS. 1, 2, 3) is carried out in a cooled mold 2. Provided under the mold is a cooled bottom plate 3 provided with an opening.

The internal surface of the hollow ingot being built-up is formed by means of a cooled rod 4 passing through the opening in the bottom plate. A bottom-pouring device 5 and a runner 6 are provided in order to supply the molten slag into the mold, as by a feed device 20, in a manner well known in the art. Slag may be also top-poured into the mold. During the remelting process, a consumable electrode 1 is fed into the slag bath. The process of remelting a hollow ingot, however, may be also carried into effect with the consumable electrode being stationary. In this case, the electrode is secured on the upper edge of the mold, being insulated therefrom by means of a packing 7, whereas the cross-sectional area of the electrode will have to be selected equal or approximating that of the hollow ingot being made in the remelting process.

Before starting the remelting process, the rod 4 is inserted in the opening of the bottom plate in such a manner that the upper end face thereof be projected over the bottom plate and will form together with the mold an annular gap. The gap between the core and opening in the bottom plate must be as small as possible in order to prevent slag from flowing out from the mold at the beginning of the remelting process. The molten slag is poured into the mold, thus forming the slag bath. Then voltage from an alternating or direct-current source, such as the power source 9, is applied to the electrode 1, the bottom plate 3 and the core 4. Power source 9 is depicted as a transformer having one terminal of its secondary connected by a lead to apply the potential from that terminal to the electrode 1 and the other terminal of its secondary connected by parallel leads to apply the potential from that other terminal to the bottom plate 3 and the core 4 (FIGS. 1 and 3) or, as shown in FIG. 2, to all three of the bottom plate 3, the core 4 and the mold 2.

As soon as the lower end of the consumable electrode and the molten slag bath are in contact, current starts to flow and melting of the consumable electrode begins. The melting of the consumable electrode results in molten metal, which gets into the annular gap, thus flowing around the upper end face 8 of the cooled core 4 projecting into the slag bath. This brings about the formation of a molten annular metal bath, from which a hollow ingot solidifes. In the remelting process, the upper end face of the cooled core will have to be maintained in the slag bath so as to prevent a solidifed crust from being formed thereon, which may interfere with the further proceeding of the remelting process.

For constantly maintaining the upper end face 8 of the core in the slag bath in the process of building up the hollow ingot, there is carried into effect the mutual movement of the mold, core and bottom plate together with the ingot being built-up and secured thereon, at a speed near that of rising of the slag bath.

Figure 3:
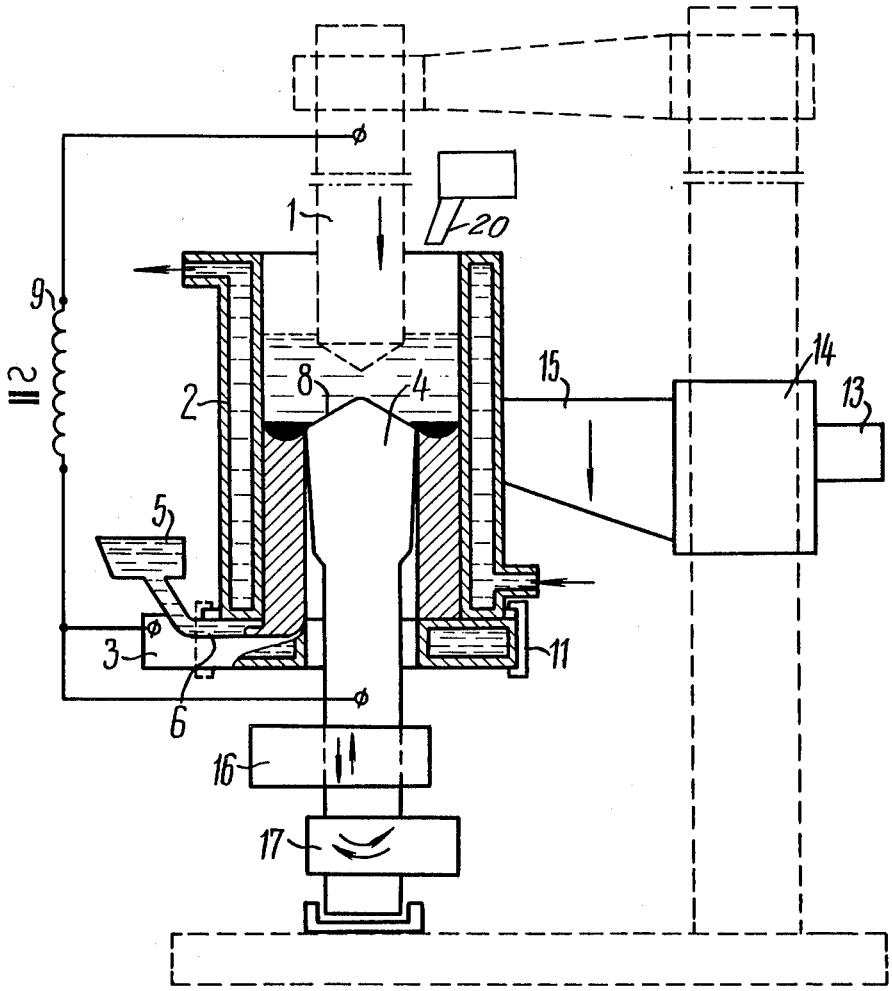
FIG. 3 represents the same device complete with a mechanism for moving the mold together with the bottom plate and the ingot being built-up downwardly in relation to the core.

Motion of the core upwardly in relation to the stationary mold and bottom plate is carried into effect by means of a mechanism 10 (FIG. 1) provided on the rod of the core. In this case, the mold is stationary and is secured on the bottom plate, for example, by means of a screw clamp 11 (FIG. 3). Pick-ups (which are not shown in the drawing) are employed for controlling the position of the upper end of the core in the slag bath.

In conformity with the second embodiment of the invention, the internal cavity of the ingot is formed by moving the bottom plate together with the ingot in relation to the core and stationary mold by having recourse to a mechanism 12 (FIG. 2) connected to the bottom plate (for example, a screw pair).

FIG. 3 represents a device for casting a hollow ingot, in which, in the process of its remelting, the mold is moved in relation to the core together with the bottom plate and the ingot secured thereon. A mechanism 13 (FIG. 3) is connected with the mold through a support 14 and a bracket 15. In this case, the mold is secured on the bottom plate by means, for example, of screw clamps 11.

To improve the internal surface of the hollow ingot the core may be connected to a mechanism 16, imparting thereto rocking motion in the longitudinal direction and/or to a mechanism 17 imparting thereto reciprocal rotary motion.

As soon as the hollow ingot of the required length is made, the voltage is disconnected and the consumable electrode is removed. In all the above-mentioned embodiments of the device, disconnection of voltage is followed by the mutual motion of the mold, core and bottom plate together with the ingot secured thereon until the core completely emerges from the ingot's cavity so as to prevent the core from being clamped in the ingot during its shrinkage in cooling.

Thereafter, the core is disengaged from its rod, and the hollow ingot is extracted.

The proposed method and device for effecting same permit hollow ingots to be produced without internal, nor external defects, from a high-quality, electroslag metal. Application of this method and device for effecting same permit elimination of expensive operations, such as drilling and piercing, when manufacturing pipe stock from cores of solid section which is of a special importance when manufacturing pipe stock from metals and alloys that are difficult to work.

The invention may be embodied in other specific forms without departing from the scope, spirit, or essential characteristics thereof. Present embodiments are, therefore, to be considered in all respects as illustrative and not restrictive, the scope and spirit of the invention being indicated by the appended claims rather than by the foregoing description and all changes which come within the meaning and range of equivalency of the claims are, therefore, intended to be embraced therein.

what is claimed and desired to be secured by Letters Patent is:

1. A device for electroslag remelting of metal comprising: a mold defining a remelting zone by the lower portion thereof: at least one consumable electrode disposed in said mold with its lowermost end in said remelting zone; means connected to said device for applying electrical power to said electrode to melt the same: means connected to said mold for supporting, enabling and controlling axial movement of said mold during remelting; means engaging said electrode and for supporting and controlling movement of said electrode: a cooled core disposed at least in part inside of said mold for forming an internal cavity in the ingot being built-up from said consumable electrode; and means for introducing molten slag to said remelting zone including a slag conducting aperture located in the structure of said mold lower portion.

2. A device as defined in claim 1, wherein said means for supporting and controlling movement of said electrode holds the end of said electrode fixed with respect to said mold during remelting and wherein said means for supporting and controlling movement of said mold enables axial motion of said cooled core with respect to said mold during remelting.

3. A device as defined in claim 1, wherein said means for supporting and controlling movement of said electrode enables axial motion of said electrode with respect to said mold during remelting and wherein said means for supporting and controlling movement of said mold enables axial motion of said cooled core with respect to said mold during remelting.

4. A device as defined by claim 3, including means to control the movement of said mold and said electrode in the same direction during melting.

5. A device as defined by claim 1, wherein the means providing electric power is connected to said electrode and to said mold.

6. A device as defined by claim 5, including a bottom plate for said mold and wherein said source of electric power is connected by parallel leads to said bottom plate and mold to maintain said mold and said bottom plate at a common electrical potential.

7. A device as defined in claim 6, wherein said bottom plate has an opening vertically therethrough and said core extends up through said opening.

8. A device as defined by claim 5, wherein said source of electric power has an A.C. output.

9. A device as defined by claim 5, wherein said source of electric power has an D.C. output.

10. A device as defined by claim 1, including a bottom plate for said mold and including means to maintain said bottom plate and said mold in contact with each other; said means for moving the mold being adaptable to move said bottom plate and said mold in the same direction during melting.

11. A device as defined in claim 10, wherein said bottom plate has an opening vertically therethrough and said core extends up through said opening.

12. A device as defined in claim 1, including means enabling top pouring of slag into the mold.

13. A device for electroslag melting of metal to make a hollow ingot comprising: mold means including a mold for retaining a molten slag bath and a bottom plate for supporting the hollow ingot produced by said device; a core member, at least a portion of said core member being adaptable and disposed for movement within said mold during melting for forming the internal cavity in the hollow ingot; means for introducing molten slag to said mold means including a slag conducting runner located adjacent to and communicating into the bottom portion of said mold means; means structurally interconnecting said mold and said bottom plate; at least one consumable electrode disposed stationary during melting on the upper edge of said mold to project axially down in said mold so its lower end will be in the molten slag bath during melting; means connected to said device for applying electrical power to said electrode to melt the same; means connected to said core member for controlling axial motion of said core member with respect to said mold and said bottom plate during melting of said consumable electrode.

14. A device as defined by claim 13, wherein the means providing electrical power is connected to said electrode and to said mold means.

15. A device as defined by claim 13, wherein said means providing electrical power is directly connected to said bottom plate.

16. A device as defined in claim 13, wherein said bottom plate has an opening vertically therethrough and said core member extends up through said opening.

17. A device as defined by claim 13, wherein said means providing electrical power has an A.C. output.

18. A device as defined by claim 13, wherein said means providing electrical power has a D.C. output.

19. A device as defined by claim 13, including means connected to said core member enabling reciprocation in its axial direction within the hollow ingot during its formation.

20. A device as defined by claim 13, including means connected to said core member enabling rotation reciprocally about its axis within the hollow ingot during its formation.

21. A device as defined by claim 13, wherein the means providing electrical power is connected to said consumable electrode means, said mold means and said core member; said mold means and said core member being at a common electrical potential whereby said core member and the hollow ingot being formed are maintained at the same common potential.

22. A device as defined by claim 21, wherein said means for providing electrical power includes electrical leads connecting both of said bottom plate and said core member to the same electrical potential.

23. A device as defined by claim 13, wherein said core member is axially aligned within said mold.

24. A device as defined by claim 13, including means provided in said mold, said bottom plate, and said core member enabling them to be fluid cooled.

25. A device as defined by claim 13, including means to reciprocate, axially, said core member and to simultaneously rotate said core member reciprocally about its axis within the hollow ingot during its formation.

26. A device for electroslag melting of metal comprising: consumable electrode means; a mold with a bottom portion for retaining a molten slag bath, a core member having at least a portion thereof positioned within said mold for forming an internal cavity in the ingot produced from the electroslag melting of metal, means for introducing molten slag to said mold adjacent to and having connection with the bottom portion of said mold, means connected to the mold for moving the mold at least in a direction along its axis during the melting of the metal, the bottom portion of said mold having an opening vertically therethrough, and said core extending up through said opening.

27. A device for electroslag melting of metal comprising: consumable electrode means; a mold with a bottom portion for retaining a molten slag bath, a core member having at least a portion thereof positioned within said mold for forjing an internal cavity in the ingot produced from the electroslag melting of metal, means for introducing molten slag to said mold adjacent to and having connection with the bottom portion of said mold, means connected to the mold for moving the mold at least in a direction along its axis during the melting of the metal, and means connected to said core member enabling rotation reciprocally about its axis within the cavity in the hollow ingot during its formation.

28. A device for electroslag melting of metal comprising: consumable electrode means; a mold with a bottom portion for retaining a molten slag bath, a core member having at least a portion thereof positioned within said mold for forming an internal cavity in the ingot produced from the electroslag melting of metal, means for introducing molten slag to said mold adjacent to and having connection with the bottom portion of said mold, means connected to the mold for moving the mold at least in a direction along its axis during the melting of the metal; and said consumable electrode means being maintained in contact with said slag bath and including a source of electric power connected to said consumable electrode means, said mold, and said core member; said mold and said core member being connected by parallel leads to a common electrical potential whereby said core member and the hollow ingot being formed are maintained at the same common potential.

29. A device as defined by claim 28 wherein said bottom portion includes a bottom plate for said mold and wherein a parallel lead connects said bottom plate to the same electrical potential as said core member.

30. A device for electroslag melting of metal comprising: consumable electrode means; a mold with a bottom portion for retaining a molten slag bath, a core member having at least a portion thereof positioned within said mold for forming an internal cavity in the ingot produced from the electroslag melting of metal, means for introducing molten slag to said mold adjacent to and having connection with the bottom portion of said mold, means connected to the mold for moving the mold at least in a direction along its axis during the melting of the metal, said bottom portions includes a bottom plate, and means are provided in said mold, said bottom plate, and said core member enabling them to be fluid cooled.

31. A device for electroslag melting of metal comprising: consumable electrode means; a mold with a bottom portion for retaining a molten slag bath, a core member having at least a portion thereof positioned within said mold for forming an internal cavity in the ingot produced from the electroslag melting of metal, means for introducing molten slag to said mold adjacent to and having connection with the bottom portion of said mold, means connected to the mold for moving the mold at least in a direction along its axis during the melting of the metal, and means to reciprocate, axially, said core member and to simultaneously rotate said core member reciprocally about is axis within the cavity in the hollow ingot during its formation.

32. A device for electroslag melting of metal to make a hollow ingot comprising; mold means including a mold for retaining a molten slag bath and a bottom plate for supporting the hollow ingot produced by said device; a core member, at least a portion of said core member being adaptable and disposed for movement within said mold during melting for forming the internal cavity in the hollow ingot; means for introducing molten slag to said mold means including a slag conducting runner located adjacent to and communicating into the bottom portion of said mold means; means structurally interconnecting said mold and said bottom plate including means enabling relative axial movement therebetween during melting, said bottom plate having an opening vertically therethrough, and said core extending up through said opening.

33. A device for electroslag melting of metal to make a hollow ingot comprising: mold means including a mold for retaining a molten slag and a bottom plate for supporting the hollow ingot produced by said device; a core member, at least a portion of said core member being adaptable and disposed for movement within said mold during melting for forming the internal cavity in the hollow ingot; means for introducing molten slag to said mold means including a slag conducting runner located adjacent to and communicating into the bottom portion of said mold means; means structurally interconnecting said mold and said bottom plate including means enabling relative axial movement therebetween during melting; and means are connected to said core member enabling reciprocation in its axial direction within the cavity of the hollow ingot during formation of the ingot.

34. A device for electroslag melting of metal to make a hollow ingot comprising: mold means including a mold for retaining a molten slag bath and a bottom plate for supporting the hollow ingot produced by said device; a core member, at least a portion of said core member being adaptable and disposed for movement within said mold during melting for forming the internal cavity in the hollow ingot; means for introducing molten slag to said mold means including a slag conducting runner located adjacent to and communicating into the bottom portion of said mold means; means structurally interconnecting said mold and said bottom plate including means enabling relative axial movement therebetween during melting, and means are connected to said core member enabling rotation reciprocally about its axis within the cavity of the hollow ingot during formation of the ingot.

35. A device for electroslag melting of metal to make a hollow ingot comprising; mold means including a mold for retaining a molten slag bath and bottom plate for supporting the hollow ingot produced by said device; a core member, at least a portion of said core member being adaptable and disposed for movement within said mold during melting for forming the internal cavity in the hollow ingot; means for introducing molten slag to said mold means including a slag conducting runner located adjacent to and communicating into the bottom portion of said mold means; means structurally interconnecting said mold and said bottom plate including means enabling relative axial movement therebetween during melting; consumable electrode means; means provided to maintain said electrode means in contact with said slag bath; a source of electric power connected to said consumable electrode means, said mold, said bottom plate and said core member; and parallel leads connect said mold, said bottom plate, and said core member to a common electrical potential to provide a common potential for said core member and the hollow ingot.

36. A device for electroslag melting of metal to make a hollow ingot comprising; mold means including a mold for retaining a molten slag bath and a bottom plate for supporting the hollow ingot produced by said device; a core member, at least a portion of said core member being adaptable and disposed for movement within said mold during melting for forming the internal cavity in the hollow ingot; means for introducing molten slag to said mold means including a slag conducting runner located adjacent to and communicating into the bottom portion of said mold means; means structurally interconnecting said mold and said bottom plate including means enabling relative axial movement therebetween during melting; and means are provided in said bottom plate, said mold and said core member enabling said mold, said bottom plate, and said core member to be fluid cooled.

37. A device for electroslag melting of metal to make a hollow ingot comprising: mold means including a mold for retainin a molten slag bath and a bottom plate for supporting the hollow ingot produced by said device; a core member, at least a portion of said core member being adaptable and disposed for movement within said mold during melting for forming the internal cavity in the hollow ingot; means for introducing molten slag to said mold means including a slag conducting runner located adjacent to and communicating into the bottom portion of said mold means; means structurally interconnecting said mold and said bottom plate including means enabling relative axial movement therebetween during melting; and means are connected to and adaptable to reciprocate, axially, said core member and to simultaneously rotate said core member reciprocally within the hollow ingot during its formation.

* * * * *

UNITED STATES PATENT AND TRADEMARK OFFICE

CERTIFICATE OF CORRECTION

PATENT NO. : 4,108,235

DATED : August 22, 1978

INVENTOR(S) : Boris E. Paton et al

It is certified that error appears in the above-identified patent and that said Letters Patent are hereby corrected as shown below:

Column 2, line 54, after "mold" delete "," and insert a --.--.

Column 2, line 54, delete "as by a feed device 20, in".

Column 2, line 55, delete "a manner well known in the art."

Column 2, line 56, delete the "." and insert --, as by a feed device 20, in a manner well known in the art.--

Column 4, line 25, change "what" to --What--.

Column 6, line 31, change "forjing" to --forming--.

Column 7, line 5, change "portions" to --portion--.

Column 7, line 21, change "is" to --its--.

Column 7, line 41, after "slag" insert --bath--.

Signed and Sealed this

*Twenty-second* Day of *January 1980*

[SEAL]

*Attest:*

SIDNEY A. DIAMOND

*Attesting Officer*

*Commissioner of Patents and Trademarks*